US005085598A

United States Patent [19]

Kinoshita

[11] Patent Number: 5,085,598

[45] Date of Patent: Feb. 4, 1992

[54] DOUBLE LOCKING TYPE ELECTRICAL CONNECTOR

[75] Inventor: Yoshiji Kinoshita, Isehara, Japan

[73] Assignee: AMP Incorporated, Harrisburg, Pa.

[21] Appl. No.: 700,026

[22] Filed: May 14, 1991

[30] Foreign Application Priority Data

May 14, 1990 [JP] Japan ..... 2-123689

[51] Int. Cl.[5] ..... H01R 13/40

[52] U.S. Cl. ..... 439/595; 439/598; 439/752

[58] Field of Search ..... 439/594, 595, 597–599, 439/752

[56] References Cited

U.S. PATENT DOCUMENTS 4,758,182 7/1988 Anbo et al. ..... 439/598
4,934,959 6/1990 Zielinski et al. ..... 439/598
4,959,023 9/1990 Watanabe et al. ..... 439/595
4,975,082 12/1990 Nagasaka et al. ..... 439/598

FOREIGN PATENT DOCUMENTS 1-64872 4/1989 Japan .

*Primary Examiner*—Paula A. Bradley
*Attorney, Agent, or Firm*—Allan B. Osborne

[57] ABSTRACT

An electrical connector comprises an insulated housing (10) having multiple electrical contact-receiving chambers (11) including lances (12) for engaging contact sections (30) of electrical contacts (32) when inserted into the contact-receiving chambers (11), a double-locking member (20) movable along the housing (10) in a first direction parallel to the contact-receiving chambers (11) and having contact-interlocking parts (21*a*) for engaging the contact sections (30) when the double-locking member (20) is moved in a second direction perpendicular to the contact-receiving chambers (11).

5 Claims, 7 Drawing Sheets

DOUBLE LOCKING TYPE ELECTRICAL CONNECTOR

BACKGROUND OF THE INVENTION

The present invention relates to a double locking-type electrical connector, that is, an electrical connector includes an insulated housing which houses electrical contacts and a double-locking member which prevents the electrical contacts housed therein from coming out.

Double-locking electrical connectors are generally classified into two types, depending on how the housing and the double-locking member are fitted together: (1) the type which inserts the double-locking member from the back end of the housing (Japanese Publication No. 1-43986) and (2) the type which inserts the double-locking member from the front end of the housing (Laid-Open Japanese Publication No. 1-64872).

The type which inserts the double-locking member from the back end of the housing is advantageous in that the locking of the electrical contacts involves a double-locking action using a lance on the housing and a locking action using a double-locking member so that (1) the retaining force of the electrical contacts is reinforced and (2) the double-locking member can be pressed in as soon as it is possible to determine if the electrical contacts are completely inserted. However, it has drawbacks in that it is difficult to waterproof.

On the other hand, the type which inserts the double-locking member from the front end of the housing is relatively easy to waterproof. However, it has drawbacks in that it does not involve a double-locking type in the strict sense of the word, it is ineffective in reinforcing the contact retaining force and it cannot effectively press in the contacts.

Therefore, it is an object of the present invention to provide a double locking-type electrical connector which has both of the advantages of the two types mentioned above; it is also a type which inserts the double-locking member from the front end of the housing and at the same time can be locked securely.

The double locking-type electrical connector of the present invention has the following characteristics. In the double locking-type electrical connector which is made up of (1) an insulated housing which is equipped with multiple electrical contact housing chambers along which are formed lances which retain the electrical into contacts and (2) a double-locking member which is fitted the above-mentioned double-locking member can move in the direction where it intersects with the contact sections of the above-mentioned electrical contacts and is equipped with electrical contact locking parts which interlock with locking parts which are formed on the above-mentioned electrical contacts due to this movement.

SUMMARY OF THE INVENTION

The present invention is the type which inserts the double-locking member from the front end of the housing as described previously. The double-locking member can be moved in the direction which intersects with the contact sections of the electrical contacts and the double-locking member is equipped with electrical contact interlocking parts which interlock with the locking part formed on the above-mentioned electrical contacts by this movement so that it is effective in that it can essentially double-lock the contacts.

DETAILED DESCRIPTION OF THE PREFERRED EMBODIMENT

Figure 1:
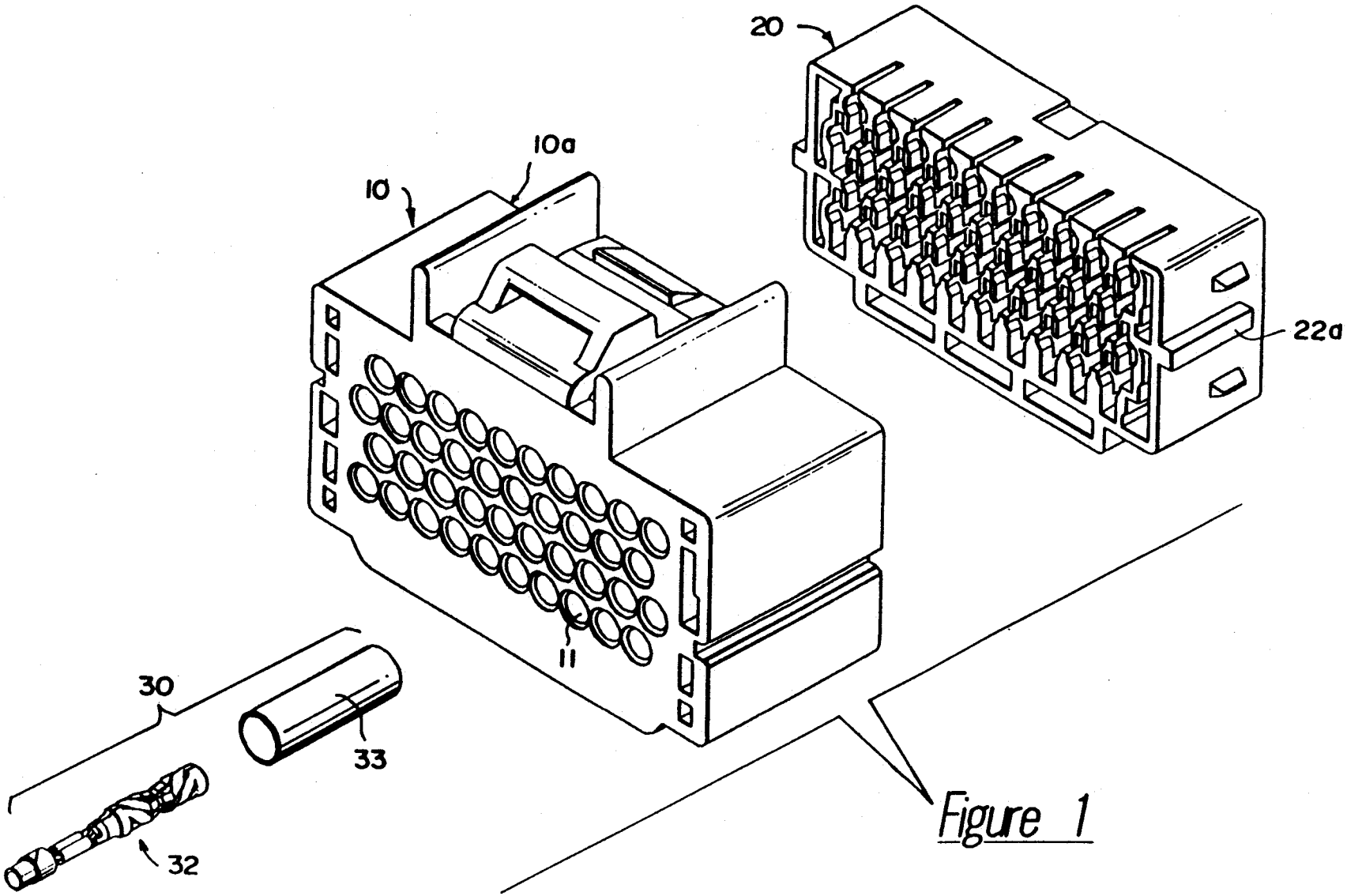
FIG. 1 is a perspective exploded view of a double-locking member of the double locking-type electrical connector and an insulated housing in the practical example of the present invention as well as an electrical contact which is housed in the housing.
Figure 2:
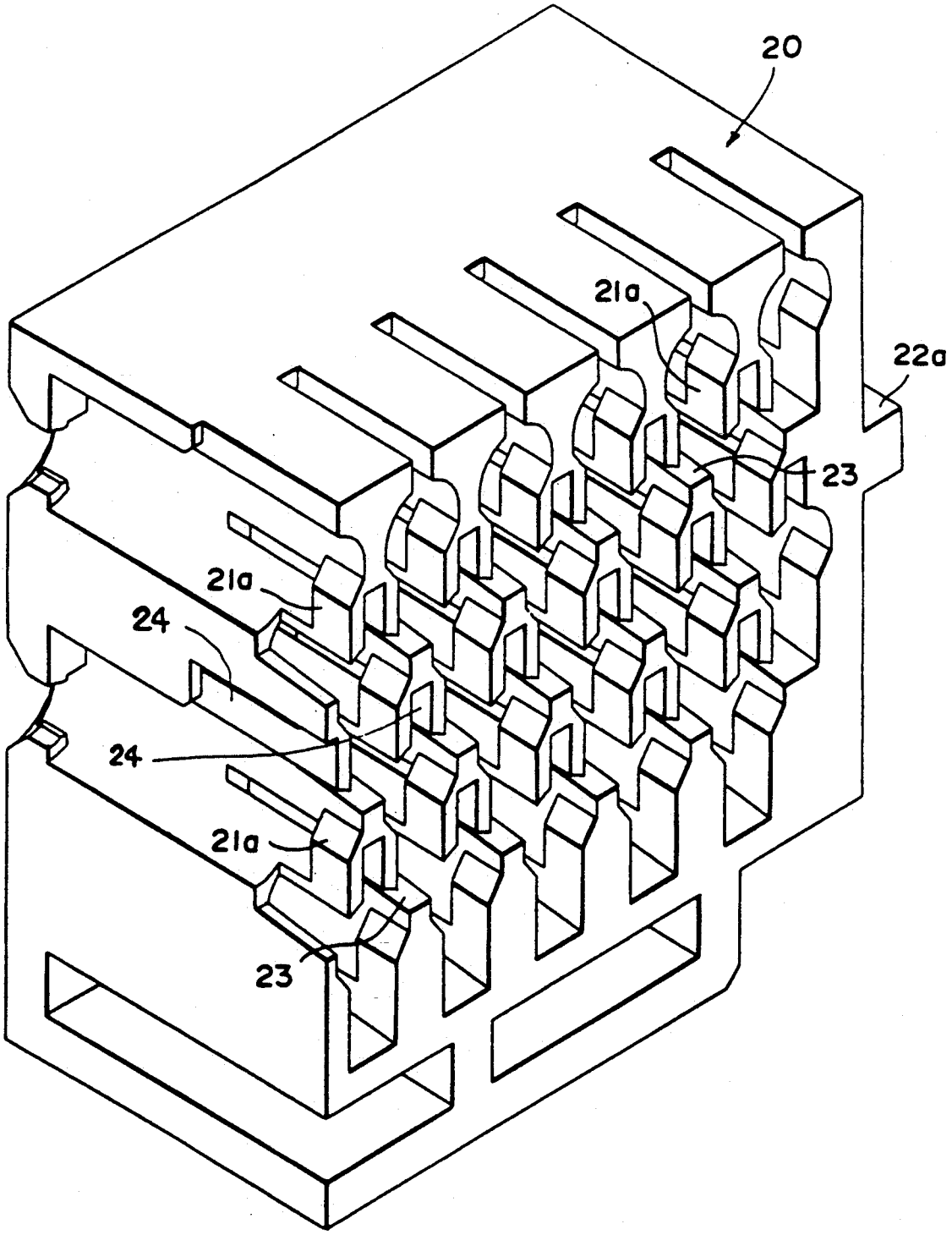
FIG. 2 is a part cut-away perspective view of the double-locking member.
Figure 3:
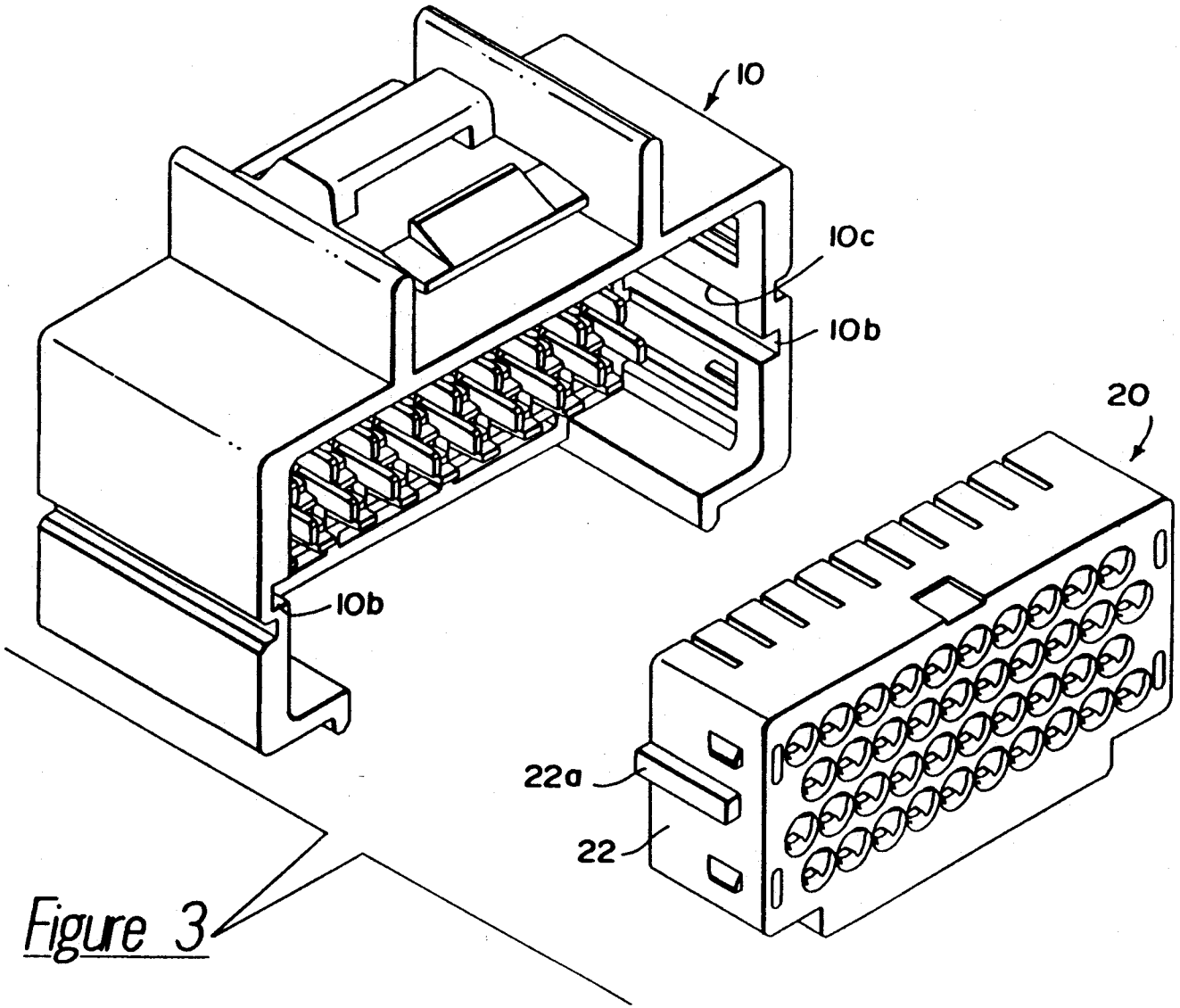
FIG. 3 is a perspective exploded view of the double-locking member and the housing seen in the opposite direction from that in FIG. 1.

The double locking-type electrical connector of the present invention is comprised of an insulated housing 10 which is equipped with multiple electrical contact housing chambers 11 and double-locking member 20 which is coplanar with the surface **10*a* which mates with the other connector (not shown in diagram) of insulated housing 10. Lances 12 which retain electrical contacts 30 (the first locking operation) are formed as part of the above-mentioned electrical contact housing chambers 11**.

The above mentioned double-locking member 20 is made so that it can move in the direction which intersects with the contact sections of the above-mentioned electrical contacts 30 (direction A indicated in FIG. 6A) and is equipped with an electrical contact interlocking part **21*a* (the double-locking plate which will be described later) which interlocks (the second locking operation on the locking part 31 which is formed on the above-mentioned electrical contact 30** by this motion.

The double-locking member 20 indicated in FIG. 1 fits into the insulated housing 10 and a large number of electrical contacts 30 which are made up of a contact member 32 and a ferrule 33 and which are crimped to an electrical wire are inserted in the respective electrical contact housing chambers 11 of the insulated housing 10 and the locking parts 31 of electrical contacts 30 are pressed in until they interlock with lances 12 of the electrical contact housing chambers 11. The electrical contacts 30 lock into insulated housing 10 by this action (indicated in FIG. 4A by the dotted lines).

Figure 4A:
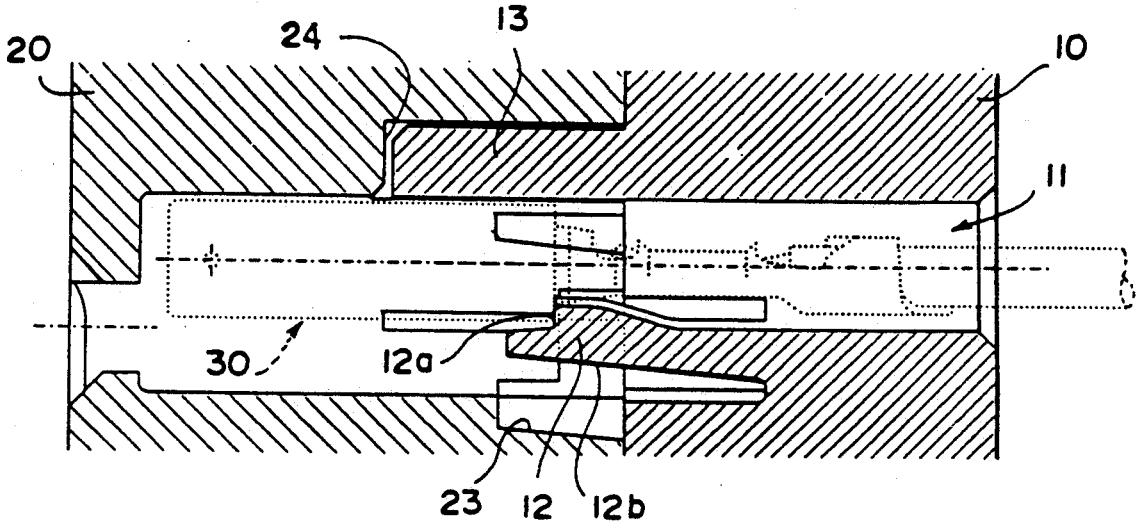
FIGS. 4A and 4B are respectively a vertical cross-sectional view and a horizontal cross-sectional view when the double-locking member is in the temporary locking mode.
Figure 6A:
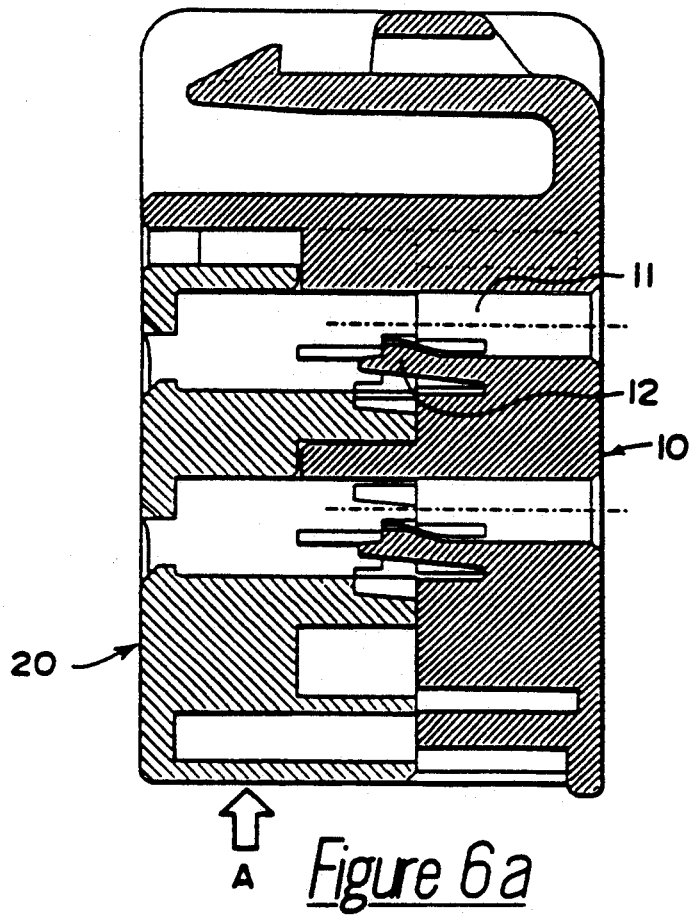
FIG. 6A is a vertical cross-sectional view of the combined double-locking member and the housing when the double-locking member is at the temporary locking mode.
Figure 7:
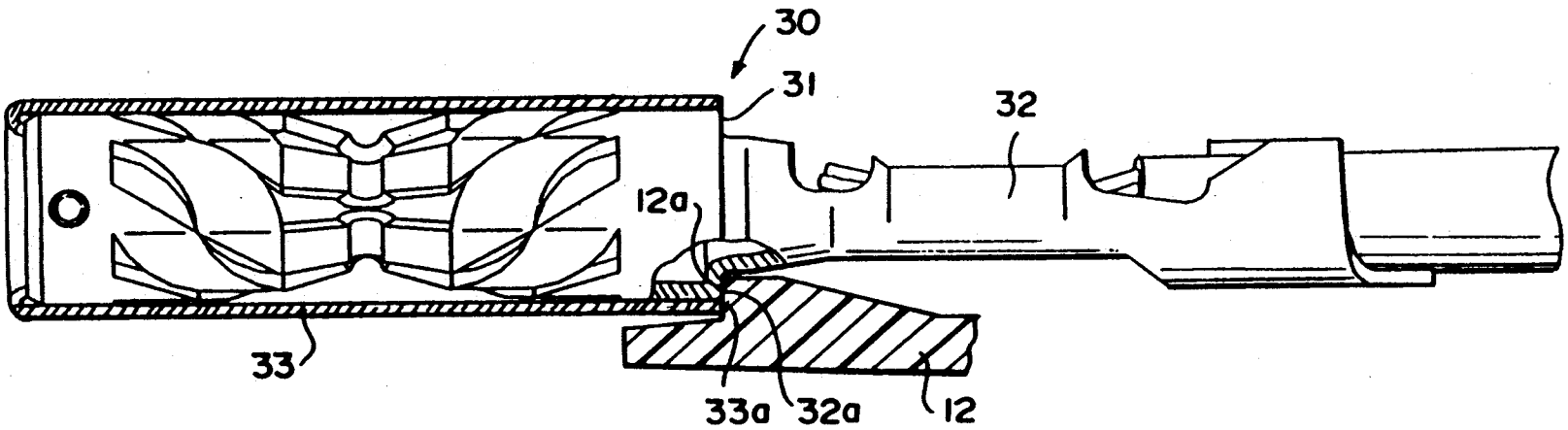
FIG. 7 is an enlarged cross-sectional view which indicates the relationship between the electrical contact and the lance side of the housing used in the above-mentioned practical example.

Lance 12 is located on the lower surface of the partition of electrical contact housing chamber 11 and extends upward so that the stepped part 12A interlocks with the lower part of the stepped part of the electrical contact 30 (see FIGS. 4A, 6A and 7).

Figure 4B:
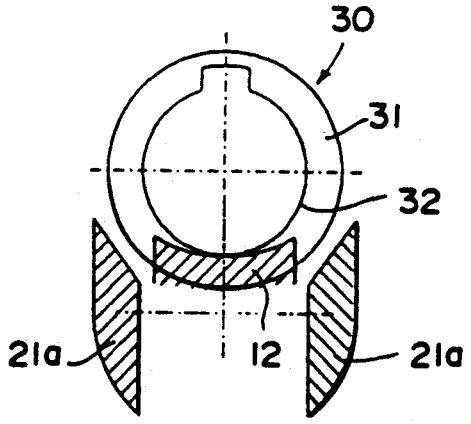

This is the temporary locking mode. At this time, the double-locking plate 21*a* of the double-locking member 20 is out of engagement with electrical contact 30 as indicated in FIG. 4B. At this time, the rib 22*a* which is formed on each side surface 22 of the double-locking member 20 mates with groove 10*b* which is formed on the inside surface of each side wall of the insulated housing 10.

Figure 5A:
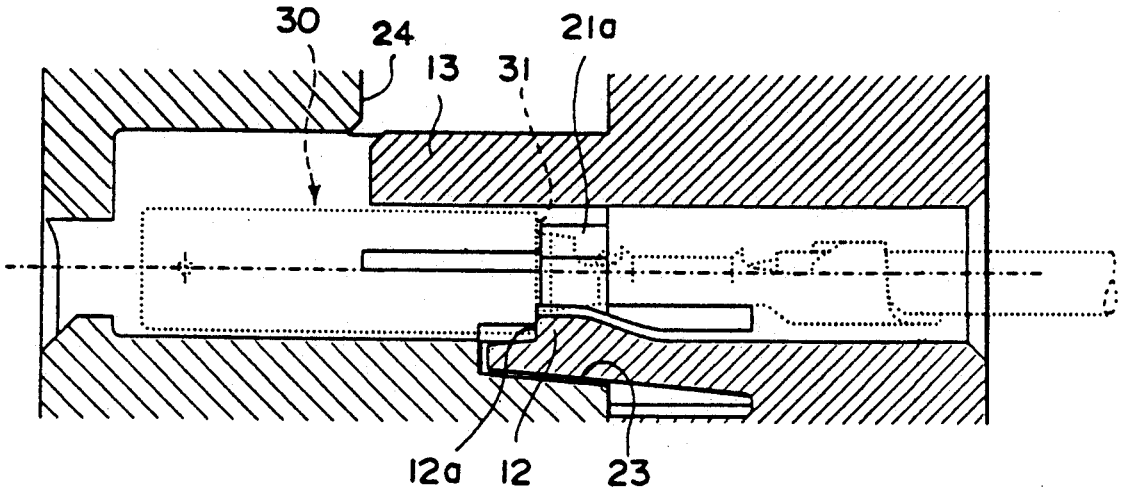
FIGS. 5A and 5B are respectively a vertical cross-sectional view and a horizontal cross-sectional view of the double-locking member when it is at the principal locking mode.
Figure 5B:
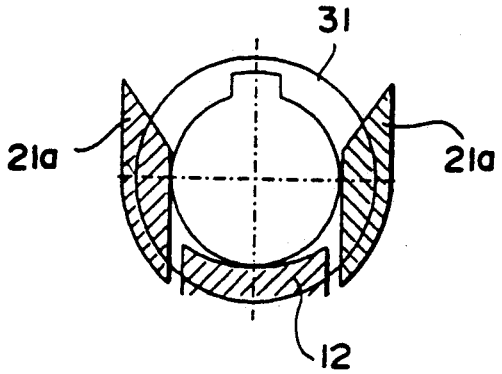
Figure 6B:
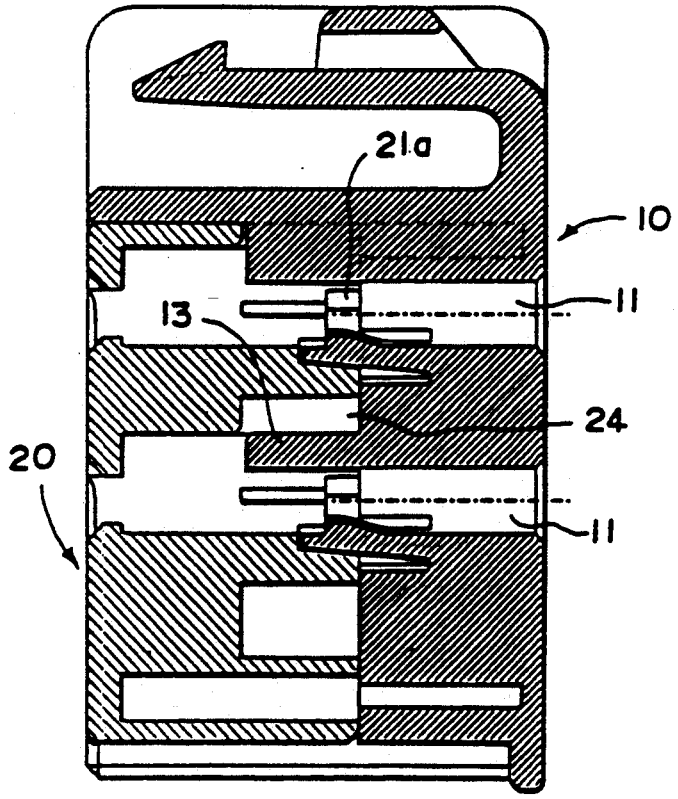
FIG. 6B is a vertical cross-sectional view of the double-locking member when it is in the principal locking mode.

Next, when the double-locking member 20 is pushed from this mode in the direction A indicated in FIG. 6A, the double-locking member 20 approaches the notch 10*c* formed at the back of the above-mentioned groove 10*b* so that it can be moved upward. The double-locking member 20 moves upwards by this action as indicated in FIGS. 5A, 5B and 6B, the above-mentioned double-locking plate 21*a* interlocks with the side part of the locking part 31 of the electrical contact 30.

The insulated housing 10 is equipped with a contact support part 13 which protrudes horizontally so that it faces the side of the double-locking member 20. Double-locking member 20 is equipped with a recessed part 24 which receives this.

In the practical example shown in the drawings, when the lance support surface 23 of the double-locking member 20 moves upward (the principal-locking mode), the lance support surface 23 of the double-locking member 20 supports the bottom surface 12*b* of lance 12 from the bottom (it need not make direct contact) and lance 12 is prevented from slipping downward and coming unlocked from electrical contact 30.

In the practical example of the drawings, lance 12 interlocks with both the end 33*a* of the ferrule 33 on electrical contact 30 and the stepped part 32*a* of the electrical contact member 32 so that the retaining force is reinforced.

The position where it locks with lance 12 of the insulated housing 10 is the end of the ferrule in the illustrated practical example. However, this is not always needed and it may be used, for example, as an interlocking hole part as indicated in Published Japanese Utility Model No. 54-15173. There is a pair of electrical contact interlocking parts 21*a* on the above-mentioned double-locking member 20. This is desirable for the strength, however, it is by no means mandatory and just one interlocking part 21*a* is suitable as well.

In the practical example shown in the drawings, the double-locking member is moved in the direction A which intersects with the contact section of the electrical contact so that the electrical contact is double locked. However, when the double-locking member is moved frontward on an incline (the left upward direction in FIG. 6A), it is effective in that the electrical contact which does not reach the normal position is pushed until is reaches the normal position.

In the present practical example, when the electrical contact is inserted incompletely, the lance which is not at the normal position and the support surface of the double-locking member made contact so that the double-locking member cannot move upwards and, needless to say, it is possible to tell that the electrical contact is not inserted completely.

I claim:

1. An electrical connector comprises an insulated housing (10) having grooves (10*b*) and multiple electrical contact-receiving chambers (11) including lances (12) for engaging contact sections (30) of electrical contacts (32) when inserted into the contact-receiving chambers (11), a double-locking member (20) having ribs (22*a*) slidably receiving in said grooves (10*b*) for moving said member (20) in said housing (10) in a first direction parallel to the contact-receiving chambers (11) and having contact-interlocking parts (21*a*) for engaging said contact sections (30) when said double-locking member (20) is moved in a second direction perpendicular to the contact-receiving chambers (11).

2. An electrical connector as claimed in claim 1, wherein said grooves (10*b*) have notches (10*c*) in which said ribs (22*a*) are received thereby enabling said double-locking member to move in said second direction.

3. An electrical connector as claimed in claim 1, wherein said double-locking member (20) moves from the front to the rear of said housing (10) in said first direction.

4. An electrical connector as claimed in claim 1, wherein said double-locking member (20) includes lance support surfaces (23) for supporting said lances (12) when said double-locking member has been moved to said second position.

5. An electrical connector as claimed in claim 1, wherein said housing (10) includes contact support parts (13) along which the contact sections (30) extend and recessed parts (24) in said double-locking member (20) for receiving said contact support parts (13).

* * * * *